United States Patent [19]

Kamo et al.

[11] Patent Number: 4,713,638

[45] Date of Patent: Dec. 15, 1987

[54] POLARIZED ELECTROMAGNETIC RELAY

[75] Inventors: Yuichi Kamo; Nobuo Mikami, both of Tokyo, Japan

[73] Assignee: NEC Corporation, Japan

[21] Appl. No.: 923,087

[22] Filed: Oct. 24, 1986

[30] Foreign Application Priority Data

| | | | |
|---|---|---|---|
| Oct. 25, 1985 | [JP] | Japan | 60-164274[U] |
| Oct. 25, 1985 | [JP] | Japan | 60-164275[U] |
| Oct. 25, 1985 | [JP] | Japan | 60-164276[U] |
| May 19, 1986 | [JP] | Japan | 61-115603 |
| May 19, 1986 | [JP] | Japan | 61-75761[U] |

[51] Int. Cl.[4] ..... H01H 51/22

[52] U.S. Cl. ..... 335/79; 335/85; 335/234

[58] Field of Search ..... 335/78, 79, 81, 84, 335/85, 229, 230, 234

[56] References Cited

U.S. PATENT DOCUMENTS

| | | | |
|---|---|---|---|
| 4,538,126 | 8/1985 | Bando | 335/78 |
| 4,560,966 | 12/1985 | Nagamoto et al. | 335/85 X |
| 4,563,663 | 1/1986 | Niekawa et al. | 335/80 X |
| 4,625,191 | 11/1986 | Oberndorfer et al. | 335/78 |

*Primary Examiner*—George Harris

*Attorney, Agent, or Firm*—Laff, Whitesel, Conte & Saret

[57] ABSTRACT

A bistable type of electromagnetic relay has a movable block including a pair of permanent magnet units. Each of the magnet units has a permanent magnet and a pair of generally U-shaped magnetic plates attached to its opposite poles. A rotation of the movable body actuates relay contact members. A yoke has opposite ends, each formed by a pair of opposing end pieces, the end of the magnetic plates being arranged in spaces defined by the opposing end pieces. A coil supporting a spool has a through-hole for receiving a core which is inserted therein. Flanges are formed at opposite ends and at a center portion of the spool, with a plurality of protrusions protruding outwardly on both sides of each flange. A pair of base members have grooves and recesses for receiving the protrusions on the flanges of the spool, for rotatably supporting the movable block.

20 Claims, 25 Drawing Figures

POLARIZED ELECTROMAGNETIC RELAY

BACKGROUND OF THE INVENTION

1. FIELD OF THE INVENTION

The present invention relates to a polarized electromagnetic relay (hereunder referred to as "PE relay") which comprises an electromagnetic block including an iron core and a coil wound thereon, and a pair of permanent magnet units.

2. DESCRIPTION OF THE PRIOR ART

An example of a conventional PE relay is disclosed, for example, in U.S. Pat. No. 4,538,126.

SUMMARY OF THE INVENTION

An object of this invention is to provide a PE relay free from the disadvantages found in the prior art relay and capable of suppressing a fluctuation in magnetic reluctance and to perform excellent contact switching.

Another object of the present invention is to provide a PE relay in which the vibration of the permanent magnet units, at the operating time thereof, is restricted to prevent chattering from occurring.

A further object of the present invention is to provide a PE relay including a movable block which is compact and has a satisfactory structural strength and has a space which is large enough to receive the actuating part, so that a magnetic force exerted on the permanent magnet units is transmitted efficiently to the contact springs.

Still another object of the present invention is to provide a PE relay which is easy to assemble.

Still further, an object of the present invention is to provide a PE relay in which bending and/or twisting of structural members thereof is restricted to increase the assembling accuracy and thus realize a smooth-contact-switching operation.

Yet a further object of the present invention is to provide a PE relay which can easily constitute an early-make-before-break contact.

Yet a further object of the present invention is to provide a PE relay in which a variety of contact structures can be provided.

In order to achieve these objects, the inventive bistable type of electromagnetic relay has a movable block including a pair of permanent magnet units. Each magnet unit is composed of a permanent magnet and a pair of generally U-shaped magnetic plates attached to the opposite magnetic poles of the permanent magnet, respectively. Each magnetic plate has a first end and a second end, which are opposed when attached to the poles of the permanent magnet, respectively. A support member supports the permanent magnet units at its opposite ends, respectively. Contact members are actuated responsive to movements of the supporting member and its permanent magnet units.

A core has opposite ends placed between the first ends of the magnetic plates, respectively.

A yoke has opposite ends, each formed by a pair of opposing end pieces. The second ends of the magnetic plates are arranged in spaces defined by the opposing end pieces, respectively.

A spool supporting a coil and including a through-hole has a core inserted therein.

Flanges are formed at opposite ends and a center portion thereof, respectively.

A plurality of protrusions protrude outwardly from both sides of each of the flanges.

Each pair of base members has grooves and recesses for receiving the protrusions of the flanges of the spool. Protrusions are formed on side surfaces of the inner walls of the base member for engaging the protrusions of the spool in response to a longitudinal movement of the base member. Contact members are operated responsive to the movable block. The base members are assembled at both ends of the spool.

BRIEF DESCRIPTION OF THE DRAWINGS

The above objects and features of the present invention will be more clearly understood by the following detailed description of preferred embodiments in conjunction with the accompanying drawings in which:

In the drawings, the same reference numerals depict the same structural elements.

FIG. 1 shows a magnetic circuit construction of the conventional PE relay which includes a generally I-shaped iron core 91 on which an energizing coil 92 is wound, a yoke 93 having at each of the opposite ends thereof a pair of opposing end pieces **93*a* and 93*b* and a movable block 97. The block 97 is composed of a supporting member of a non-magnetic material having, at the opposite ends thereof, permanent magnet units 96*a* and 96*b*, respectively. Each of the units 96*a* and 96*b* is composed of a permanent magnet 95 and a pair of magnetic plates 94*a* and 94*b* attached to the magnetic poles of the magnet 95, respectively. The opposite ends of the core 91 are disposed between the yoke end pieces 93*a* and 93*b*, respectively, to form four magnetic gaps between the opposite end surfaces of the core 91 and the end pieces 93*a* and 93*b* of the yoke 93**. The magnet units 96*a* and 96*b* are arranged such that each of the magnetic plates 94*a* and 94*b* is positioned in one of the four gaps to form energizing spaces, with the end piece 93*a*. The magnetic plate 94*a*, the end of the core 91, the magnetic plate 94*b* and the end piece 93*b* are layered. The movable block 94 responds to a direction of current, to be supplied to the coil 92, in order to move block 94 in either direction A or B, under the guidance of a coil spool (not shown) or a base member (not shown) to thereby actuate contact members (not shown).

Figure 1A:
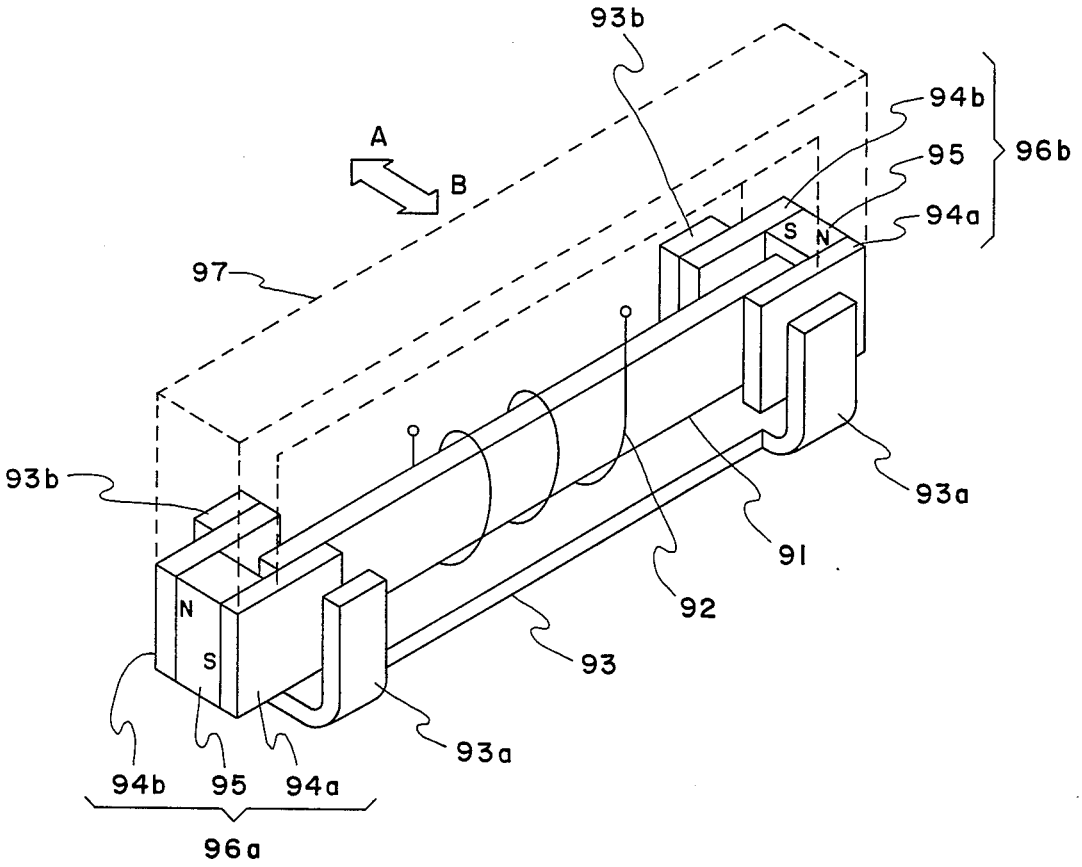
FIG. 1A (PRIOR ART)
FIGS. 1A and 1B are diagrams of a basic structure of a conventional PE relay.
Figure 1B:
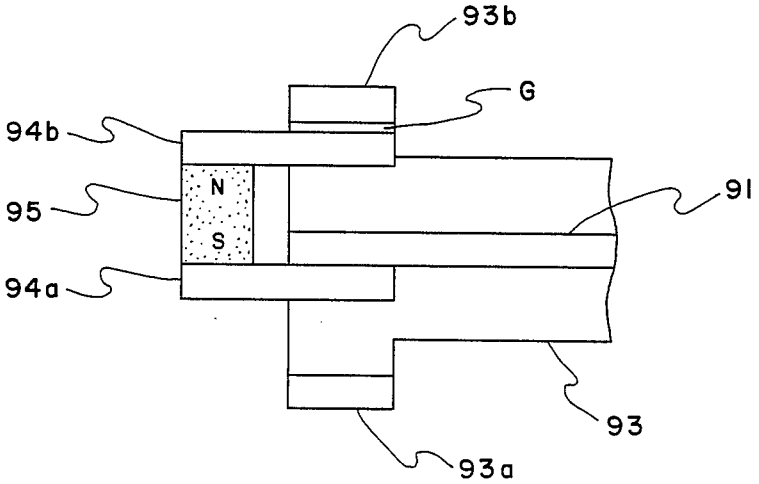
FIG. 1B (PRIOR ART)

With such construction of the conventional relay, if the core 91 (FIG. 1B) is not arranged exactly with respect to the yoke 93 or if the magnetic plates 94*a* and 94*b* are not manufactured precisely, there may be an air gap G between the end piece 93*b* and the magnetic plate 94*b*, as shown in FIG. 1B, even when the core 91 is in contact with the plate 94*a*. The resulting variation of magnetic resistance makes it impossible to have a stable switching operation between the contact members. Further, with such an air gap G, when the magnet unit 96*a* (FIG. 1A) is attracted to the side of the end piece 93*a* and the magnetic plate 94*a* comes in contact with the core 91, the plate 94*b* may vibrate, which causes a chattering to occur at a time of switching. In order to obtain an improved dimensional accuracy, it is necessary to bend the respective end pieces 93*a* and 93*b* of the yoke 91 at exactly a right angle, making the manufacturing of the relay difficult.

Furthermore, in the conventional structure, the core 91 (FIG. 1A) and the end pieces 93*a* and 93*b* are arranged opposite each other and at the same height. Therefore, in order to transmit a magnetic force which is exerted on the plates 94*a* and 94*b* to contact members (not shown) disposed outside the permanent magnet units 96*a* and 96*b*, the movable block 97 for supporting the magnet units should have an actuating part which is formed to avoid contact with the end pieces 93*a* and 93*b*. As a result, it becomes impossible to efficiently transmit a composite force, exerted by the magnet units 96*a* and 96*b*, to the contact members. The actuating member satisfying the above requirement should be so thin that it is impossible to obtain a sufficient mechanical strength for the relay. To resolve this problem, the height and thickness of the movable block 97 should be large enough, respectively, which leads an increased size of the relay.

Further, the magnet units 96*a* and 96*b* tend to move in the same direction. However, since the units 96*a* and 96*b* are connected to each other by the supporting member, it is difficult to obtain a smooth switching operation. This is due to the fact that it is difficult to move a long member such as the movable block 97 in parallel because of friction between the magnet units 96*a* and 96*b* and the guide member (not shown). Also, one of the magnet units tends to delay its operation, with respect to the other magnet unit. Bending and/or twisting of the movable block 97, which is long with respect to its width, may affect the smooth movement of the movable block adversely.

In the conventional relay, four sets of contact members are arranged on a single long base member (not shown) to achieve an effective use of magnetic flux paths. Therefore, the productivity of the base member may be reduced due to an additional probability of an occurrence of defective lead terminals and/or movable contact springs which constitute the contact members. Further, since the base member is very long as compared with its width, there is an increased tendency of bending and twisting. Thus, the dimensional accuracy of an assembled relay is reduced and the relative positions of the contact members (not shown) may vary, causing a malfunction to occur.

DESCRIPTION OF THE PREFERRED EMBODIMENTS

Figure 2:
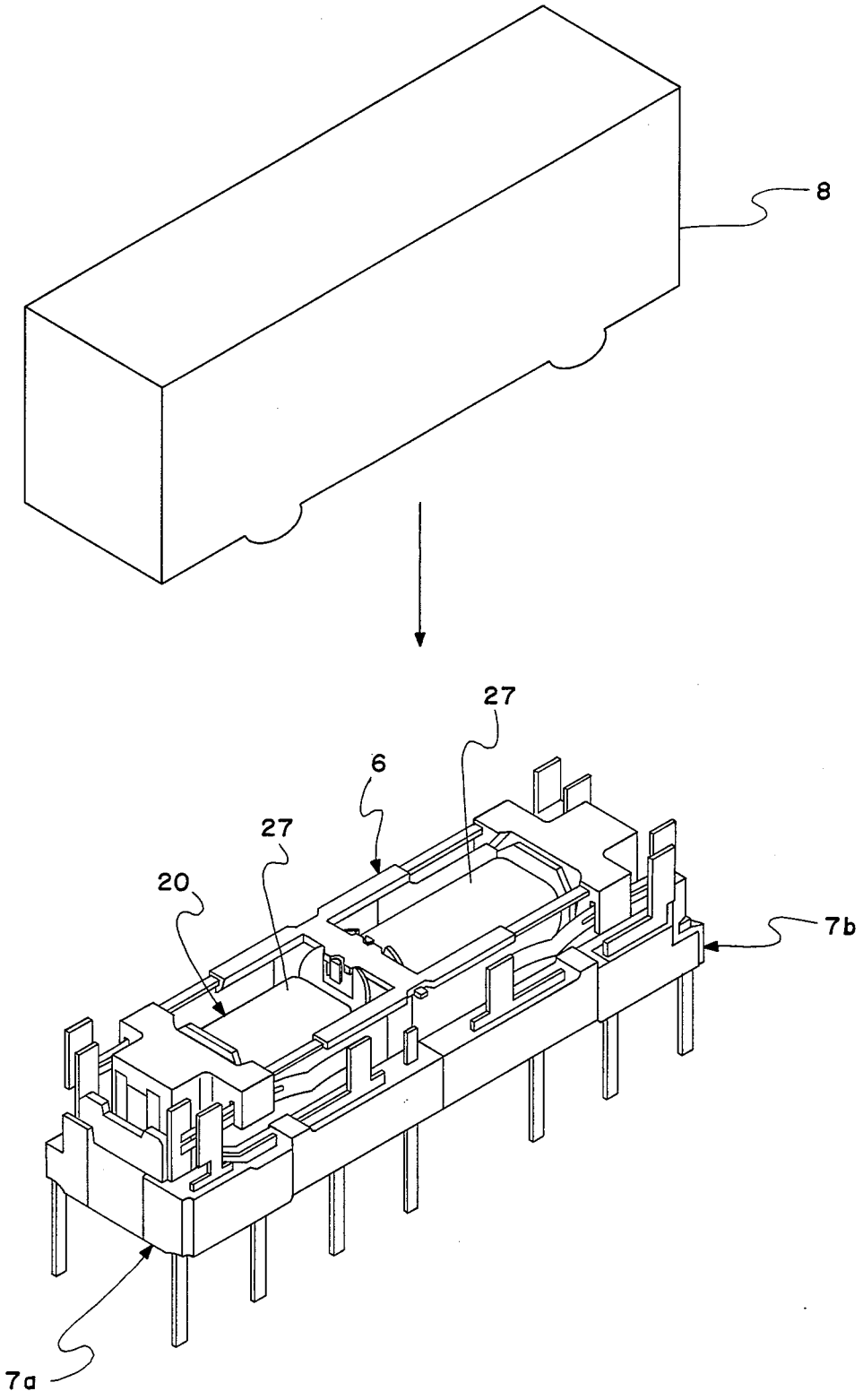
FIG. 2 is a perspective view of an embodiment of the present invention.

In FIG. 2, an embodiment of the invention comprises a movable block 6 including a pair of permanent magnets, an electromagnetic block 20 including an iron core and a yoke, a pair of base members 7*a* and 7*b* equipped with contact members (70*a* and 70*b*, in FIG. 3) and a cover member 8 (FIG. 2) for covering the base members 7*a* and 7*b*.

The relay shown in FIG. 2, is of a bistable type, which will be described in detail with reference to FIG. 3.

Figure 3:
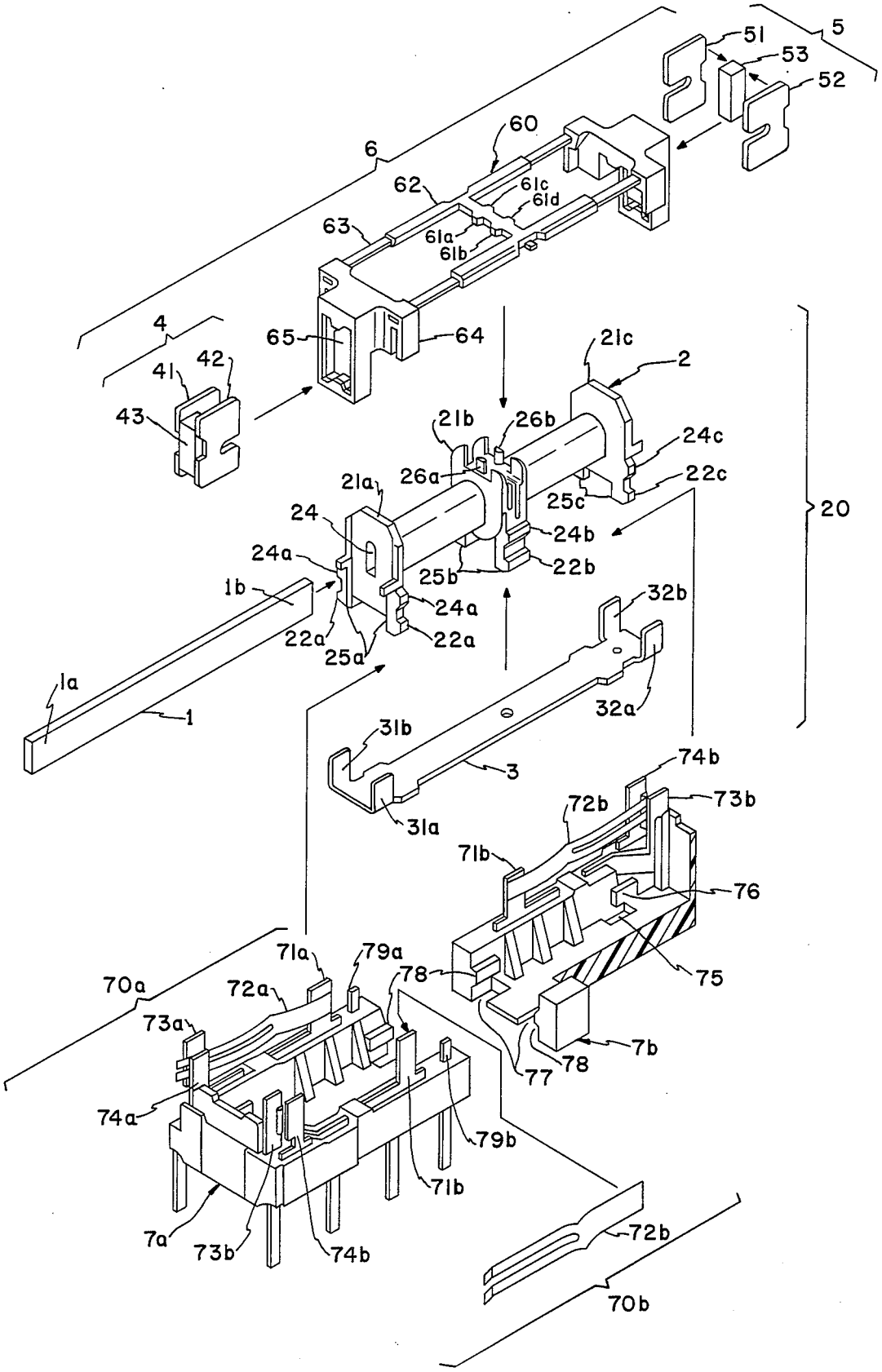
FIG. 3 is a perspective view of a portion of the embodiment shown in FIG. 2, in an exploded or disassembled state.

Referring to FIG. 3, the movable block 6 is composed of a supporting member 60 and permanent magnet units 4 and 5 which are provided in opposite end portions of the supporting member 60, respectively.

Each of the magnet units 4 and 5 is composed of the permanent magnet 43(53), a pair of generally U-shaped magnetic plates 41 and 42(51 and 52) attached to opposite magnetic poles of the magnet 43(53), respectively. In this embodiment, the plates 41 and 51 are attached to N poles of the magnets 43 and 53, respectively. The plates 42 and 52 are attached to S poles of the magnets 43 and 53, respectively. The magnetic plates 41, 42, 51 and 52 are of magnetic material such as iron. The supporting member 60 includes supporting portions 65 for supporting the units 4 and 5. Contact spring actuating parts 64 are provided on both sides of each supporting portion 65. A connecting portion 62 has four bearing protrusions 61*a*, 61*b*, 61*c* and 61*d* which constitute a bearing portion and an insert-molded reinforcing frame 63.

The electromagnetic block 20 is composed of the core 1, a coil spool 2, a coil 27 wound on the spool 2 and a yoke 3. The core 1 is of magnetic material, such as pure iron, and is inserted into a through hole 24 formed longitudinally in the spool 2. The spool 2 has flanges 21*a*, 21*b* and 21*c* provided at both ends and a center thereof, respectively. The flanges 21*a* and 21*c* are formed with paired legs 25*a* and 25*c*, respectively. The legs 25*a* have protrusions 22*a* and 24*a* on both sides thereof for engagement with the base 7*a*. The legs 25*c* have similar protrusions 22*c* and 24*c* on both sides thereof for engagement with the base 7*b*. The flange 21*b* is formed with paired legs 25*b*. The legs 25*b* have protrusions 22*b* and 24*b* on both sides thereof. The flange 21*b* further includes a pair of pins 26*a* and 26*b* formed on an upper portion thereof which constitute a rotary shaft for the movable block 6. Each of these pins has a generally semicircular cross section. The yoke 3 is of magnetic material such as iron and has a pair of upright end pieces 31*a* and 31*b* at one end thereof and a pair of upright end pieces 32*a* and 32*b* at the other end thereof. The yoke 3 is fixedly supported by the paired legs 25*a*, 25*b* and 25*c* of the flanges.

The base members 7*a* and 7*b* have contact members 70*a* and 70*b*, respectively. The member 70*a* includes a movable contact spring 72*a* having one end fixed to a common terminal 71*a* and the other end positioned between a stationary contact terminal 73*a* (e.g. a make side terminal) and another stationary contact terminal 74*a* (e.g. a break side terminal). The member 70*b* includes a movable contact spring 72*b* having one end fixed to a common terminal 71*b* and the other end positioned between stationary contact terminals 73*b* (e.g. make side) and 74*b* (e.g. break side). A switching operation, between the make and break sides, is performed by the actuating part 64 of the movable block 6. The base member 7*b* is identical to the base member 7*a*, with an arrangement of the contact members which is symmetrical with respect to the base member 7*a*.

Movable contacts (not shown) are formed on both surfaces of free ends of the contact springs 72*a* and 72*b*, respectively. A stationary contact (not shown) is formed on an inner surface of each of the electrically conductive terminals 73*a*, 73*b*, 74*a* and 74*b*, to face toward the electrically conductive springs 72*a* and 72*b*.

Each of the base members 7*a* and 7*b* is formed with grooves 75 and recesses 77 and with protrusions 76 and 78 for assembling the base members with the spool 2. That is, the spool 2 is fixedly secured to the base members 7*a* and 7*b* by engaging the protrusions 22*a* and 24*a*, and the protrusions 22*c* and 24*c* with the grooves 75 and the protrusions 76 of the base members 7*a* and 7*b*, respectively. The protrusions 22*b* and 24*b* are engaged with the recesses 77 and the protrusions 78 of the bases 7*a* and 7*b*. A pair of coil terminals 79*a* and 79*b* are press-fitted to either one of the base members 7*a* and 7*b* for making an electrical connection to the coil 27.

The relay is assembled by assembling the movable block 6 onto the electromagnetic block 20 with the opposite ends 1*a* and 1*b* of the core 1 being sandwiched between the magnetic plates 41, 42 and 51, 52, respectively. Thereafter, the cover 8 (FIG. 2) is put thereon. In this embodiment, the spool 2, the base members 7*a* and 7*b* and the cover 8 are made of electrically insulative resin material.

An operation of the embodiment of the invention will be described with reference to FIGS. 4A, 4B, 5A and 5B. As mentioned previously (FIG. 3), the inventive relay is composed, basically, of the block 20 (including the core 1, the coil 27 and the yoke 3) and the movable block 6 of FIG. 4A (including the pair of the magnet units 4 and 5). As also mentioned previously, the end pieces 31*a* and 31*b* are formed on one end portion of the yoke 3 and are formed in a facing relation by bending them at a right angle. The end pieces 32*a* and 32*b* are formed in the other end portion of the yoke 3 and are bent similarly. The height of the pieces 31*a*, 31*b*, 32*a* and 32*b* is lower than the position of the core 1. Each of the magnetic plates 41, 42, 51 and 52 has an upper end 41*a*, 42*a*, 51*a* and 52*a* and a lower end 41*b*, 42*b*, 51*b* and 52*b*, respectively. The core ends 1*a* and 1*b* are positioned between the upper ends 41*a* and 42*a* of the plates 41 and 42 and between the upper ends 51*a* and 52*a* of the plates 51 and 52, respectively. The movable block 6 is positioned such that the lower plate ends 41*b* and 42*b* are positioned within a space defined between the yoke end pieces 31*a* and 31*b* in facing relations thereto. The lower plate ends 51*b* and 52*b* are positioned within a space defined between the yoke end pieces 32*a* and 32*b*.

The plates 41 and 51 and the plates 42 and 52 serve as N poles and S poles, respectively, due to the permanent magnets 43 and 53. On the other hand, the core 1 is magnetized by a current supplied to the coil 27 which is wound thereon. The core ends 1*a* and 1*b* have opposite magnetic polarities which depend upon the direction of the current.

The movable block 6 is pivoted to rotate in a direction shown by an arrow (FIG. 4A) due to an attractive or reactive force exerted between the stationary poles by the magnets 43 and 53 and the switchable poles of the core 1, the poles being produced by an energization of the coil 27. A center axis 69 of the pivot motion of the block 6 is constituted with the pins 26*a* and 26*b* (FIG. 3) of the spool 2 and the protrusions 61*a*, 61*b*, 61*c* and 61*d* of the movable block 6.

Figure 5A:
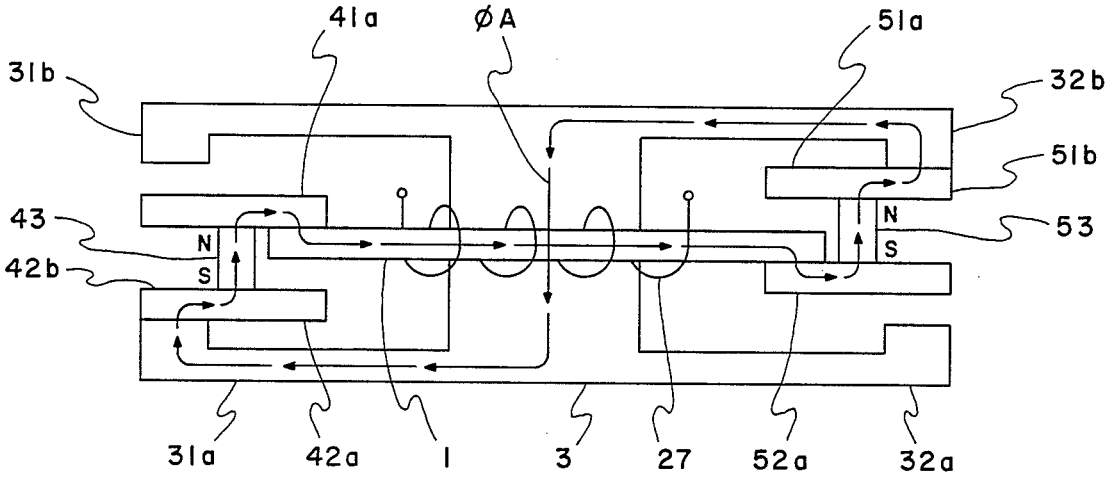
FIGS. 5A and 5B are diagrams for illustrating an operation of the magnetic structure shown in FIG. 4A, in principle.
Figure 5B:
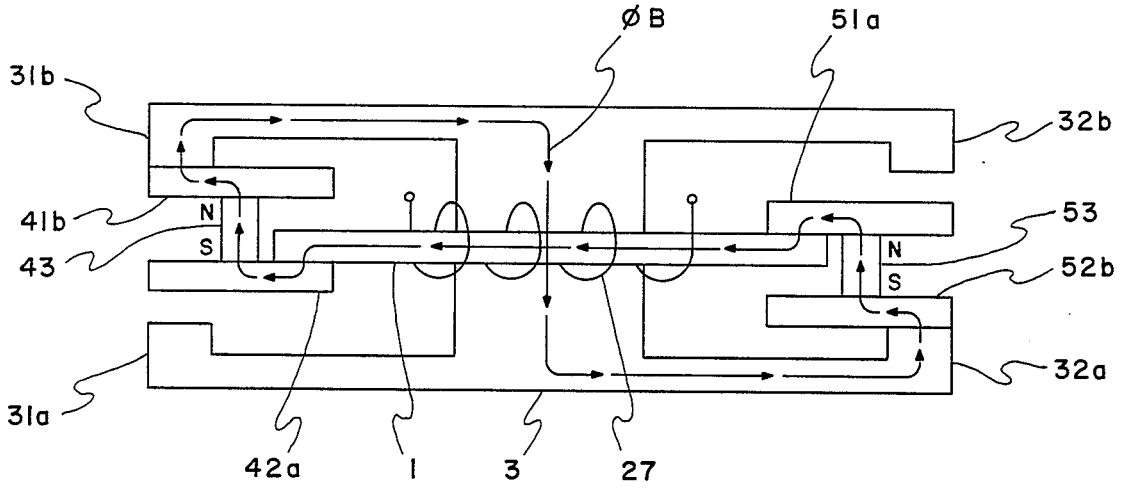

In FIG. 5A, the magnet units 4 and 5 are shown in a state in which the plate end 42*b* of the unit 4 is attracted to the side of the yoke end piece 31*a* and the plate end portion 51*b* of the unit 5 is attracted to the side of the yoke end piece 32*b*. Magnetic flux $\phi_A$ passes from the magnet 43 through the plate end 41*a*—the core end 1*a*—the core end l*b*—the plate end 52*a*—the magnet 53—the plate end 51*b*—the yoke end piece 32*b* the yoke end piece 31*a*—the plate end 42*b*—and the magnet 43, thus providing a closed magnetic circuit to hold the attracted condition.

When a current is supplied to the coil 27 such that the core ends 1*a* and 1*b* become an N pole and an S pole, respectively, reactive forces are produced between the core end 1*a* and the plate end 41*a* and between the core end 1*b* and the plate end 52*a*. Attractive forces are produced between the core end 1*a* and the plate end 42*a* and between the core end 1*b* and the plate end 51*a*. As a result, the movable block 6 is pivoted to a position shown in FIG. 5B. Magnetic flux $\phi_B$ forms a closed magnetic circuit in the following path, the magnet 43 through the plate end 41*b*—the yoke end pieces 31*b*—the yoke end pieces 32*a*—the plate end 52*b*—the magnet 53—the plate end 51*a*—the core ends 1*b*—the core end 1*a*—the plate end 42*a*—the magnet 43. Even when the electric current supply is cut off, the block 6 holds the state (FIG. 5B) by itself, due to the magnetic flux of the magnets 43 and 53. That is, the block 6 operates bidirectionarily to form a bistable type relay.

Figure 6:
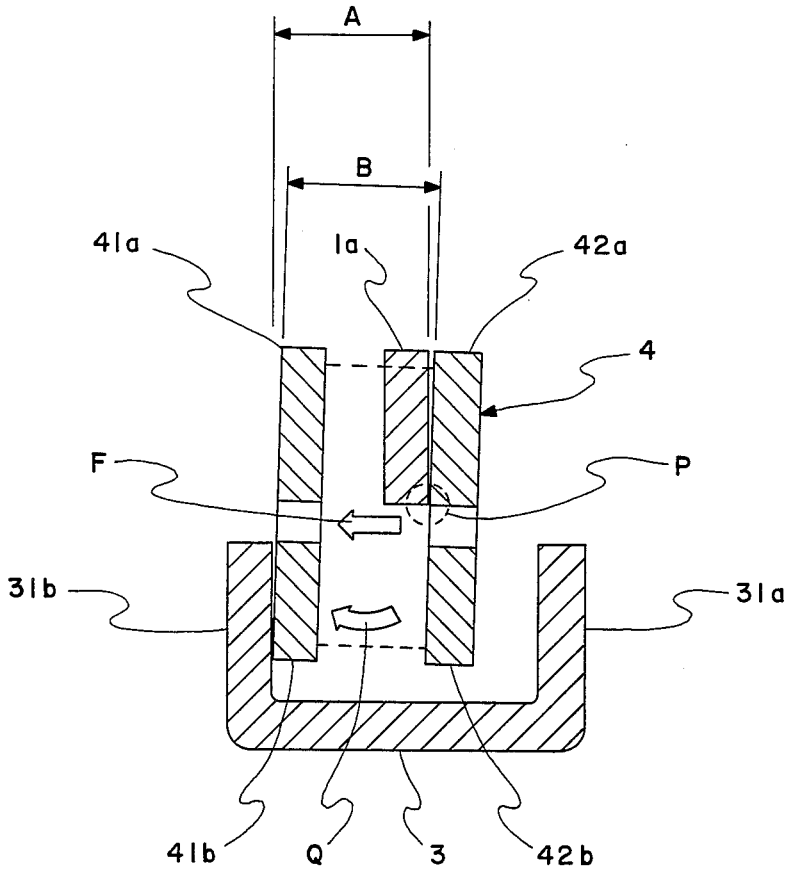
FIG. 6 is a cross sectional view of a modification of the structure shown in FIG. 4A for illustrating an effect of the present invention.

FIG. 6 shows a magnetic structure wherein a distance A between a right side surface of the core end 1*a* and an inside surface of the yoke end piece 31*b* does not coincide with a distance B between an inside surface of the magnetic plate 42 and an outside surface of the plate 41 (A>B) due to an insufficient precision in the bending of the yoke end pieces 31*a* and 31*b*. In such a case, there may be a gap between the end piece 31*b* and the plate end 41*b* even when the magnet unit 4 is moved by a total magnetic force F exerted thereon. The core end 1*a* comes into contact with the plate end 42*a*. However, due to an attractive force acting between the end piece 31*b* and the plate end 41*b* and to a reactive force acting between the end piece 31*a* and the plate end 42*b*, the magnet unit 4 is subjected to a rotational force Q acting around a fulcrum point P. Unit 4 is rotated clockwise within a range defined by guide members (not shown) while tilting, so that the end piece 31*b* can be in contact with the plate end 41*b*. In this manner, the core end 1*a*, the yoke end pieces 31*a* and 31*b* and the plate ends 41*a*, 41*b*, 51*a* and 51*b* can make contact with each other, respectively, even if the bending inaccuracy of the yoke 3 and/or the assembling inaccuracy of the electromagnet block 20 is not negligible.

Therefore, it is possible to realize a stable contact switching operation with a minimized variation of magnetic resistance of the magnetic circuits. Further, since the plates 41 and 42 can make reliable contact with the end pieces 31*b* and 31*a*, respectively, there is no vibration of the magnet unit 4. Thus it is possible to restrict the chattering at the moment of contact switching. These effects are commonly observed for the magnet unit 5.

A magnetic structure of a monostable type, PE relay according to the present invention will be described below.

Figure 7A:
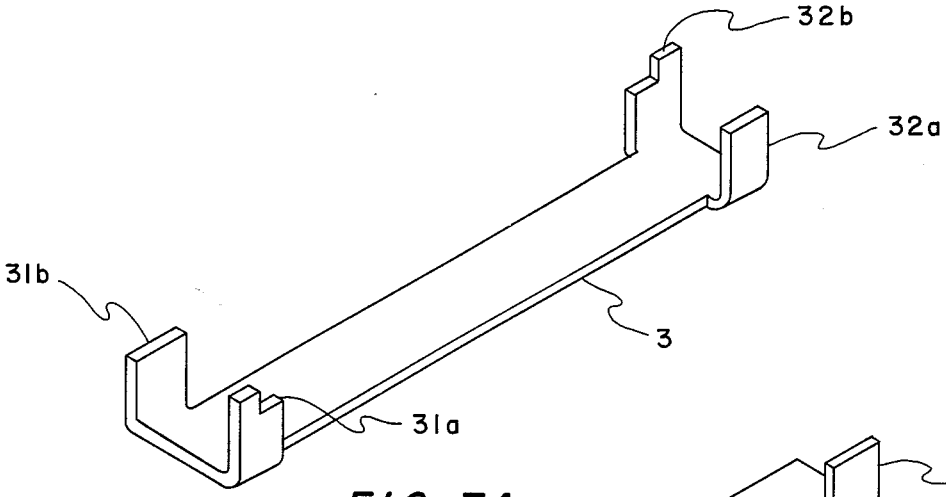
FIGS. 7A to 7C are diagrams of the first, the second and the third modifications of the magnetic structure shown in FIG. 4A, respectively.

In FIG. 7A, a first modification of the magnetic structure shown in FIG. 4 is made so that the size of the yoke end piece 31*a* (32*b*) is made different from that of 31*b* (32*a*). Specifically, the unnotched area of the yoke end piece 31*b* (32*a*) facing to the magnet unit 4 (5) is larger than the notched area of the yoke end piece 31*a* (32*b*) facing the magnet unit 4 (5). Therefore, the magnetic resistance on the side of the yoke end piece 31*a* (32*b*) is larger than the magnetic resistance on the side of the yoke end piece 32*a* (31*b*). The magnetic resistance balance is disturbed. Thus the magnet units 4 and 5 are attracted to the yoke end pieces 31*b* and 32*a*, respectively, due to a composite force of the magnetic forces and the spring forces when deenergized. When a current is supplied to the coil 27, such that the core end 1*a* becomes a South pole, the magnet units 4 and 5 are attracted to the yoke end pieces 31*a* and 32*b*, respectively, to actuate the contact members (not shown).

Figure 7B:
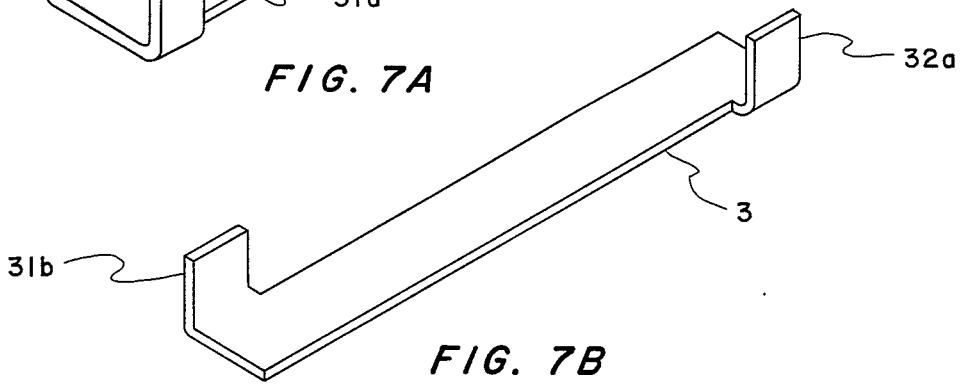

In FIG. 7B, a second modification of the structure shown in FIG. 4 is made so that the yoke end pieces 31*a* and 32*b* are removed to provide an unbalanced magnetic resistances. In this modification, it may be possible to provide stopper members (not shown) on the base members 7*a* and 7*b* (FIG. 3) or the cover 8 (FIG. 2) to restrict the movements and vibrations of the plates 42 and 51, respectively.

Figure 7C:
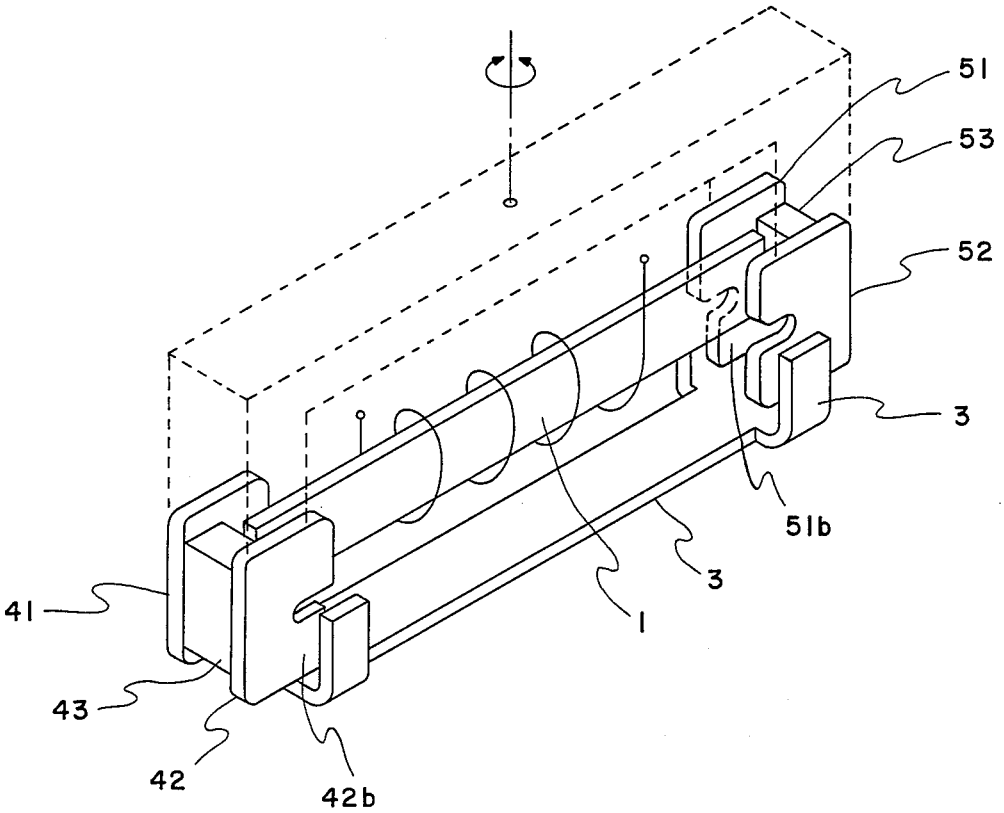

In FIG. 7C, a third modification of the structure in FIG. 4 is made so that the areas of the plate ends 42*b* and 51*b* are reduced to obtain an unbalanced magnetic resistances.

Other magnetic structures of a monostable type PE relay having residual plates will be explained.

Figure 8A:
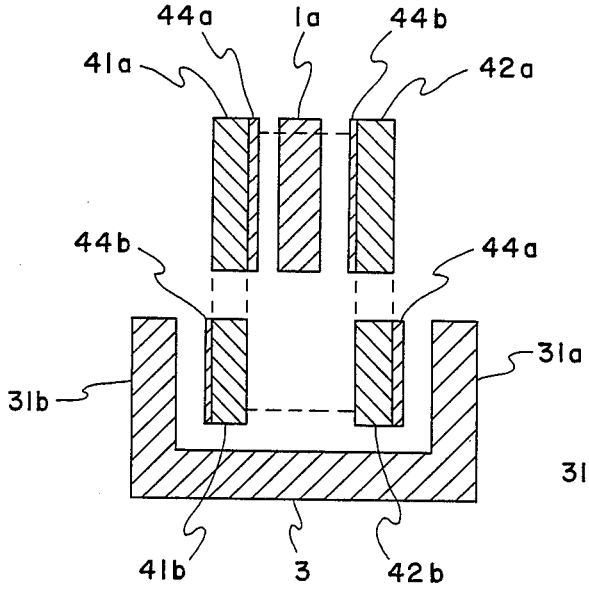
FIGS. 8A and 8B are cross sectional views of the fourth and the fifth modifications of the structure shown in FIG. 4A, respectively.

FIG. 8A shows a fourth modification of the structure in FIG. 4. In this modification, a residual plate of non-magnetic material is used to form an air gap in the magnetic circuit thereof. Thick residual plates 44*a* are provided on an inside surface of the plate end 41*a* and on an outside surface of the plate end 42*b*, respectively. Thin residual plates 44*b* are provided on an inside surface of the plate end 42*a* and on an outside surface of the plate 41*b*, respectively. The plates 44*a* and 44*b* smoothly release the contact condition of the plates 41 and 42 with the yoke end pieces 31*a*, 31*b* and the core end 1*a* when the magnet unit 4 is moved. Plates 44*a* and 44*b* also make the magnetic resistances of the circuit unbalanced due to the differences in their thickness.

Figure 8C:
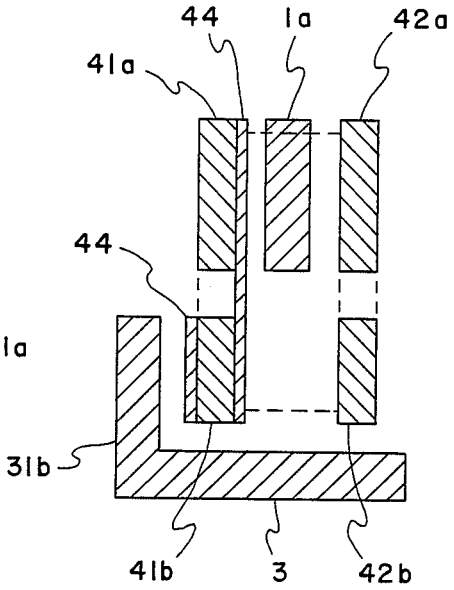
FIGS. 8C and 8D are cross sectional views of the first and the second modifications of the structure shown in FIG. 7B, respectively.
Figure 8B:
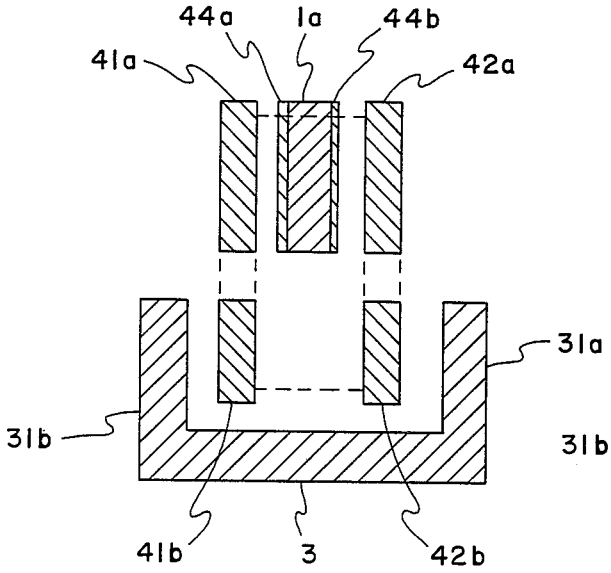

In FIG. 8B, a fifth modification of the structure in FIG. 4 is made so that the residual plates 44*a* and 44*b* are attached to the core end 1*a* on the side of the end piece 31*b* and on the side of the yoke end piece 31*a*, respectively.

FIG. 8C shows a modification of the magnetic structure having the yoke 3 shown in FIG. 7B. In this modification, the yoke end piece 31*a* is eliminated and the residual plates 44 are attached to the inside and outside surfaces of the plate 41.

Figure 8D:
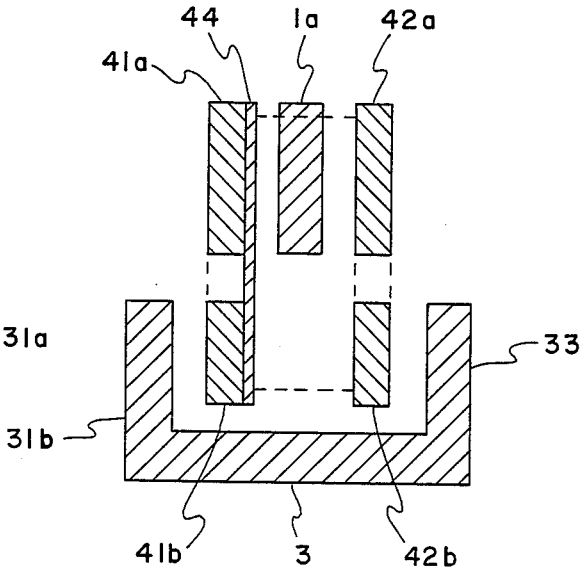

FIG. 8D shows another modification of the structure having the yoke 3 shown in FIG. 7B. In this structure, a stopper 33 of non-magnetic material such as a non-magnetic alloy is mounted by, for example, pressure pressing, instead of the eliminated yoke end piece 31*a*.

Figure 4A:
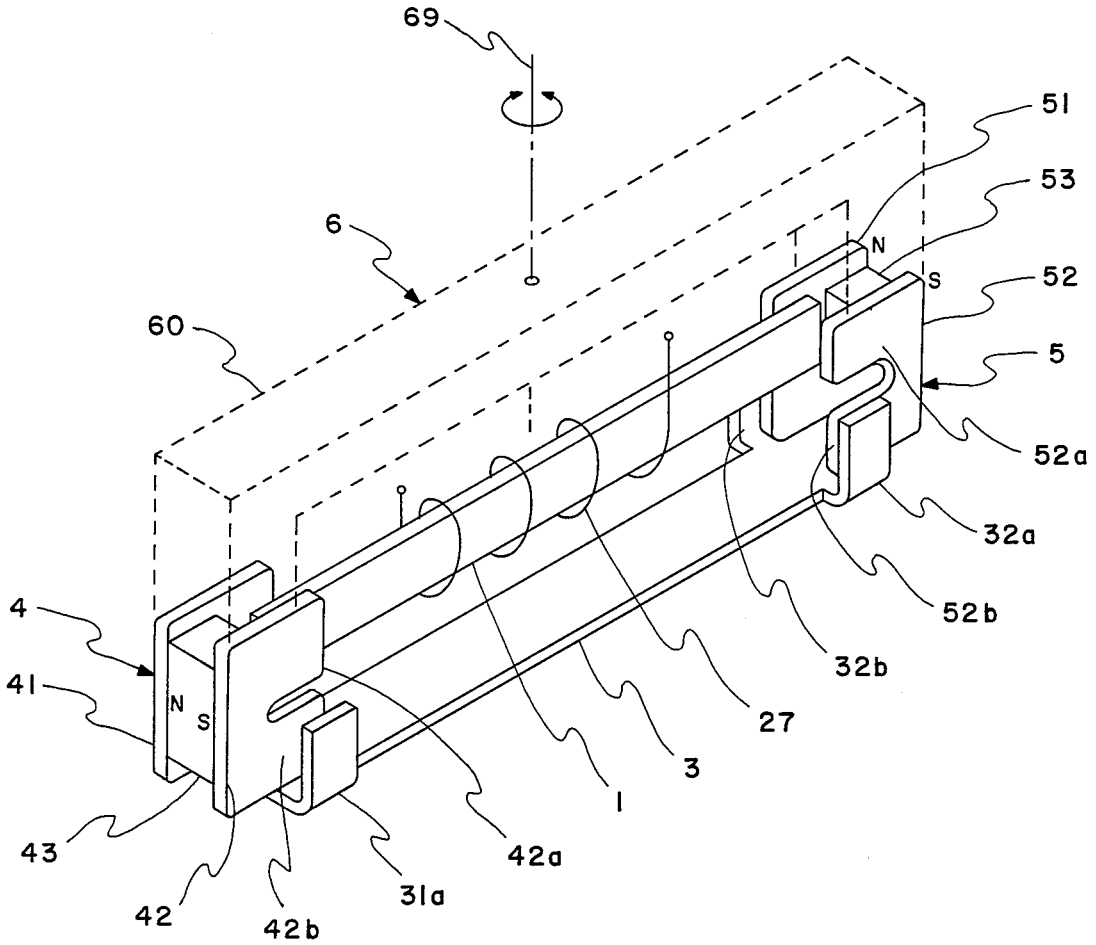
FIGS. 4A and 4B are diagrams for describing a magnetic structure of the embodiment shown in FIG. 2.
Figure 4B:
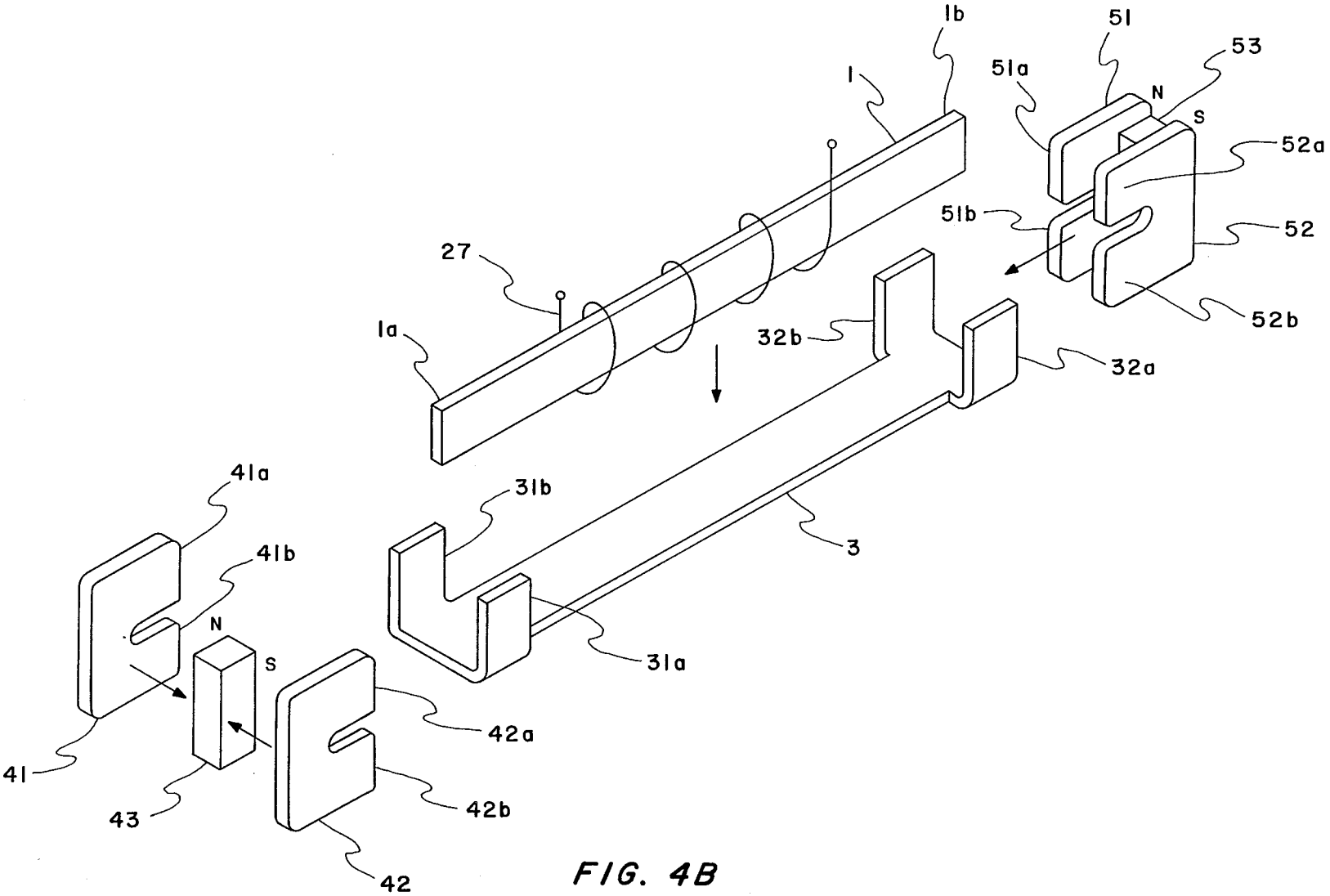

In any of the FIGS. 8A to 8D, the magnetic balance is broken positively. Therefore, the magnet unit 4 is attracted to the side of the yoke end piece 31*b* due to a composite force including the spring forces acting on the contact members (not shown), when it is deenergized. In FIGS. 8A and 8B, the magnetic unbalance is provided by the difference of the residual plate thickness. Although described for the magnet unit 4, the same principle is applicable for the magnet unit 5 which is symmetrical thereto about the shaft 69 (FIG. 4A).

Figure 9A:
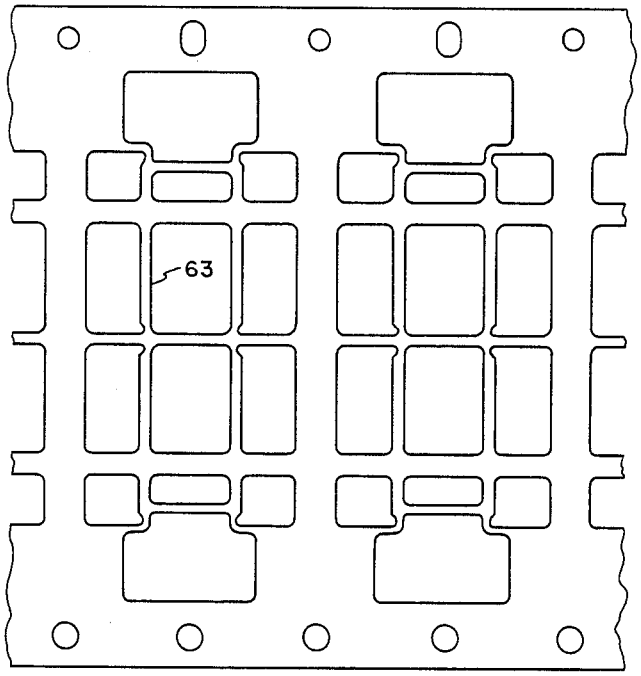
FIGS. 9A and 9B are views for illustrating a manufacturing process of the portion of the relay shown in FIG. 3.
Figure 9B:
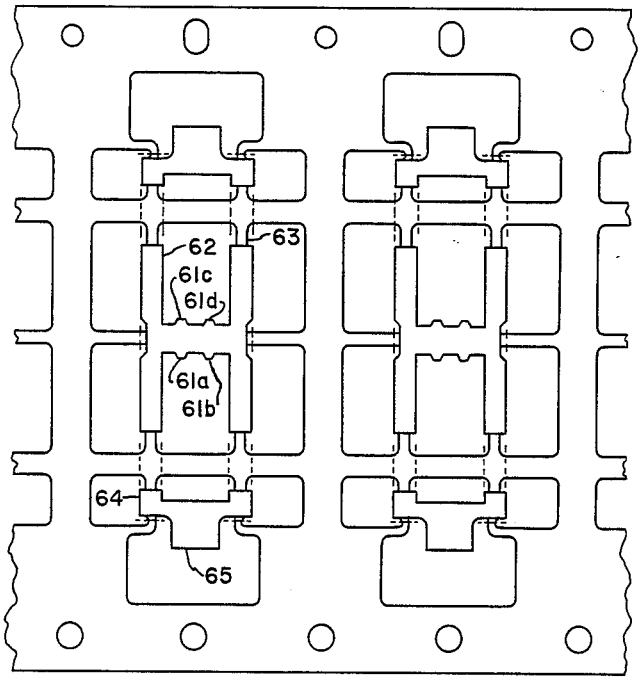

The supporting member 60 shown in FIG. 3 will be described with reference to FIGS. 9A to 9C. A plurality of the supporting members 60 can be produced simultaneously, as follows:

(a) preparing a plate of non-magnetic, high strength metal such as phosphor bronze and having a plurality of mutually connected reinforcing frames 63 (FIG. 9A);

(b) insert-molding the frames 63 with insulating resin;

(c) forming the supporting parts 65, the actuating parts 64 and the connecting portions 62 including the bearing protrusions 61*a*, 61*b*, 61*c* and 61*d*; and (d) cutting away portions shown by dotted lines (FIG. 9B).

With the insert-molding of the frames 63, it is possible to restrict any bending and/or twisting thereof which might otherwise occur at the connecting portions 62 between the magnet units 4 and 5. Thus it is possible to produce the supporting members 60 which can provide a high assembling accuracy at a low cost. A production line of the members 60 may be automated easily, according to this method. In the best mode, a portion of the frame 63 is exposed to minimize the resin molded portion as shown in FIG. 9B. This is important because, when, in the insert-molding process, resin injection is not sufficient, the thickness of resin on opposite surfaces of the frame 63 may become non-uniform and asymmetrical. Thus a small bending of the frame 63 may occur during shrinkage of the resin, when hardened. On the other hand, when resin is injected with too much pressure, the frame 63 may be bent and/or deformed. Therefore, it is desired to minimize the molded portion and to increase the number of connecting points connecting the frames 63 to each other in the molding process. However, if the thickness of the resin can be controlled suitably, it may be possible to mold all of the frames 63 and then to form the members 60.

Figure 9C:
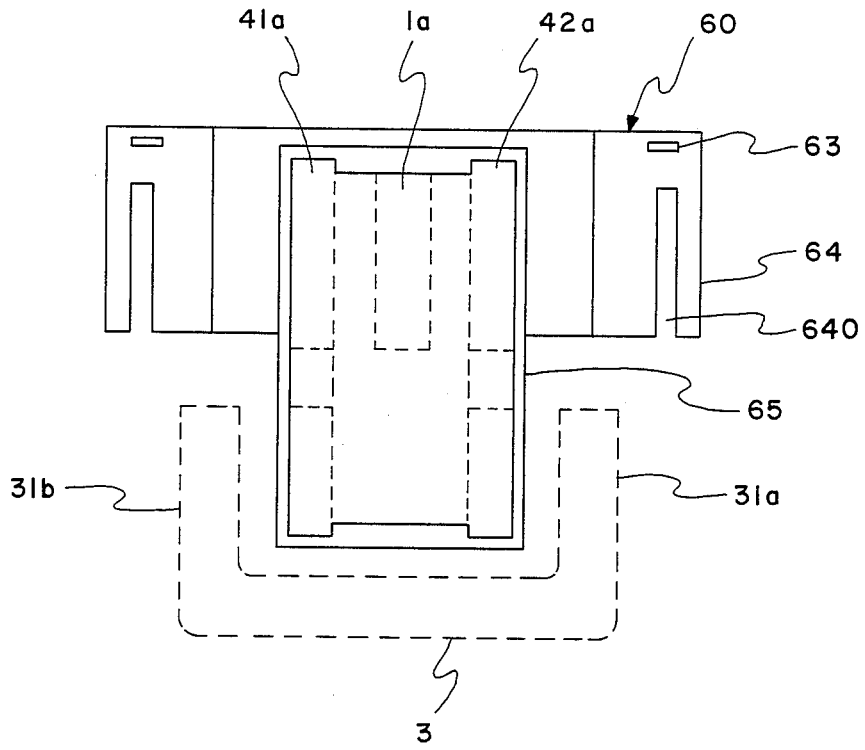
FIGS. 9C and 9D are views which show portions of the structure in FIG. 3 in detail, respectively.

In FIG. 9C, each actuating part 64 is formed with a slit 640 into which the contact member is to be inserted. In upper portions of the yoke end pieces 31*a* and 31*b*, which are lower in level than the core end 1*a*, spaces are provided. The actuating part 64 can linearly transmit a magnetic force acting on the magnetic plates 41 and 42 with the aid of the spaces and provide a sufficient structural strength, without increasing the height of the supporting member 60.

Figure 9D:
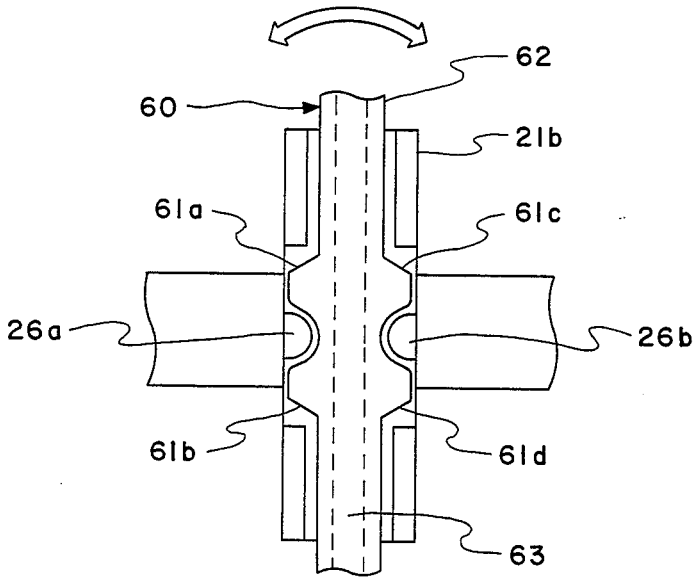

FIG. 9D shows the bearing structure for guiding the rotation of the movable block 6 (FIG. 3), in detail. The pins 26*a* and 26*b* protrude upwardly from the flange 21*b* of the spool 2 and are disposed between the bearing protrusions 61*a* and 61*b* provided in the connecting portion 62 of the supporting member 60 and between the bearing protrusions 61*c* and 61*d* provided in the same connecting portion 62, respectively. That is, the pins 26*a* and 26*b* are held loosely with the connecting portion 62 being therebetween. The movable block 6 can be pivoted in the arrow directions. In this bearing structure, minute particles generated by friction between the pins 26*a*, 26*b* and the protrusions 61*a*, 61*b*, 61*c*, 61*d* may be released therefrom. Therefore, a smooth movement can be maintained for the bearing portion for a long period of time due to a lubricating function thereof. Further, this does not prevent a slight tilting of the magnet units 4 and 5.

As mentioned above, the supporting member 60 is compact in size and light in weight, while having a sufficient mechanical strength and accuracy to realize a satisfactory contact switching operation.

Figure 10:
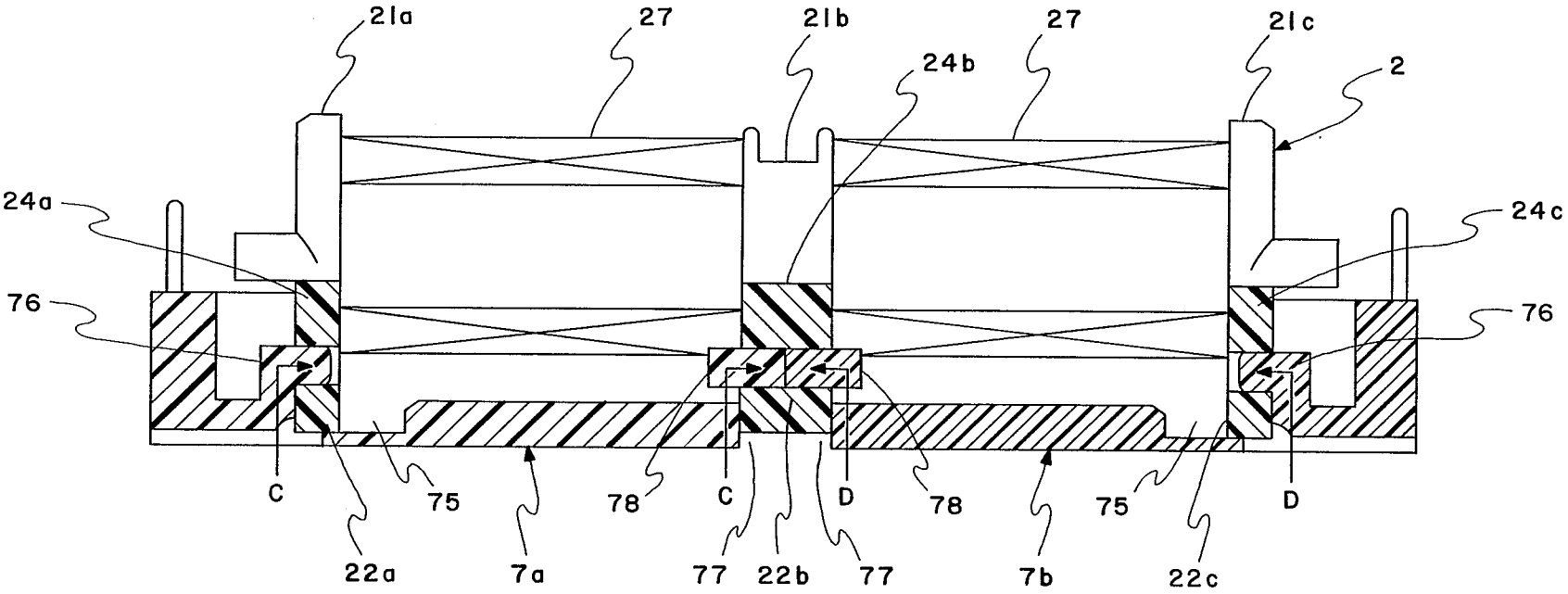
FIG. 10 is a view for illustrating a portion of the structure shown in FIG. 3 in an assembled state.

An assembling of the spool 2 and the base members *7a* and *7b* will be described with reference to FIGS. 3 and 10. The base member *7a* is pushed up to the structure until the protrusions *22a* of the spool 2 reach the bottom of the grooves 75 and then slide laterally and fixed, along the direction of an arrow C. The base member *7b* is assembled similarly, with the sliding direction being opposite, as shown by an arrow D. That is, since the spool 2 and the base members *7a* and *7b* are easily and fixedly assembled by the fittings between the protrusions *22a, 22b, 22c, 24a, 24b* and *24c* of the spool 2, and the protrusions 78 and 76 of the base members *7a* and *7b*, it is possible to prevent a vibration of the structure at the contact switching time.

After the base members *7a* and *7b* are assembled to the spool 2, lateral movements thereof are prevented by inner walls of the cover 8 assembled thereafter, to thereby prevent an accidental disassembling of the structure. Since this assembling process can be achieved without using fixing members such as screws, the assembly process of the relay can be facilitated with minimum cost. Further, due to the employment of the paired base members *7a* and *7b*, the number of parts to be mounted on each base member is reduced by half as compared with the conventional base member. Thus the probability of defective products is reduced considerably, resulting in an improved productivity. Furthermore, due to the length of the base member, which is reduced by a half as compared with the conventional base member, the bending and/or twisting thereof is minimized, resulting in an improved assembling accuracy.

Since the movable block 6 is rotated about the shaft 69 (FIG. 4A), a positional relationship between the make-side and the break-side of the contact member becomes symmetrical about a point. Therefore the structure of the base members *7a* and *7b* may be identical. It should be noted that the protrusions *24a, 24b* and *24c* may be omitted, if necessary. Further, the grooves 75 are formed to penetrate partially the base members *7a* and *7b* (See FIG. 10). Thus, if the structure is sealed with resin for sealing the base members *7a, 7b* and if the cover 8 is employed, the same resin adheres to the protrusions *22a, 22b* and *22c* to provide an additional fixing strength.

Figure 11:
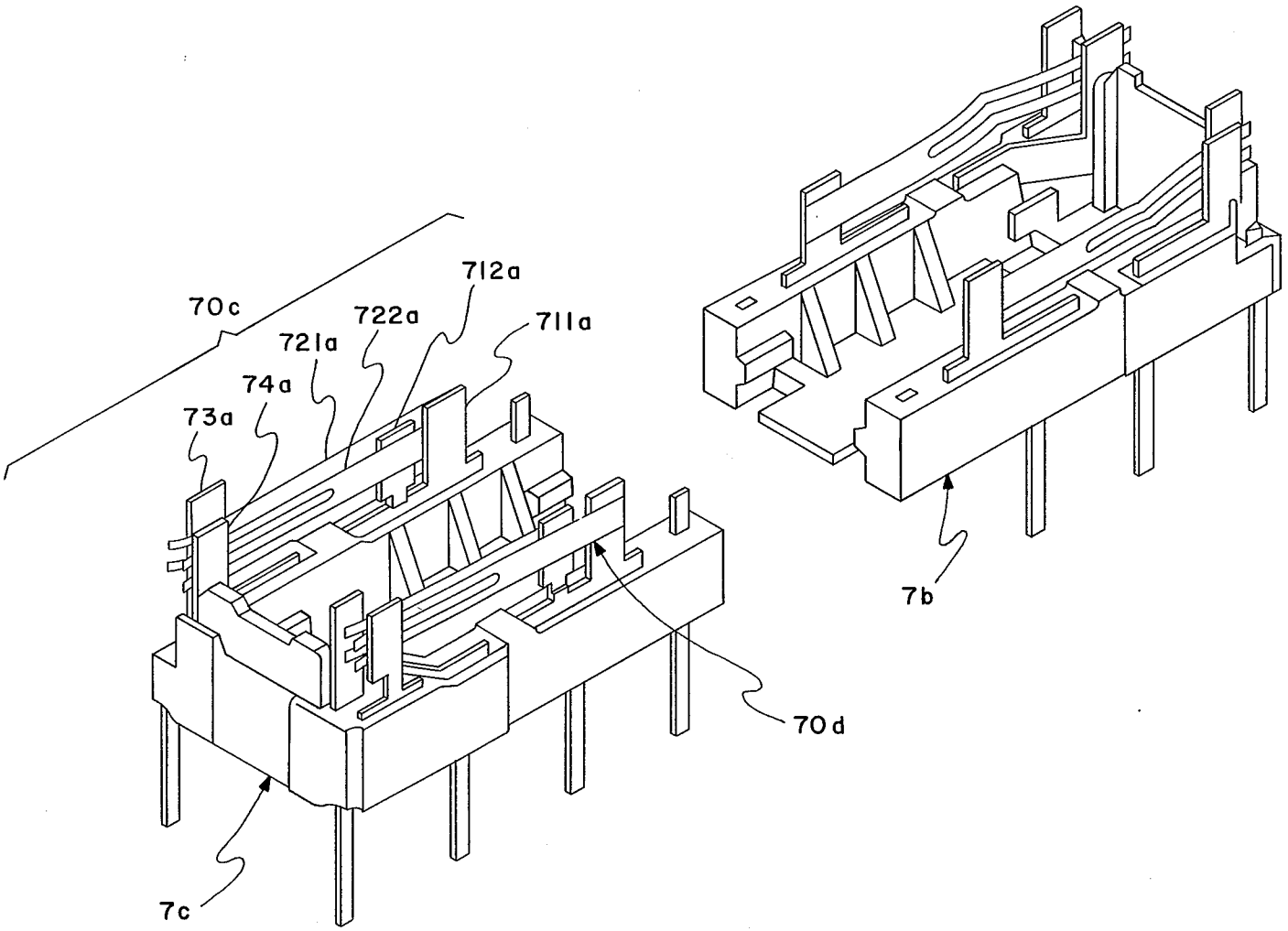
FIG. 11 is a view to show a modification of a portion of the structure shown in FIG. 3.

A modification of the base member shown in FIG. 3 will be described with reference to FIG. 11. The base member *7c* has two contact members *70c* and *70d*. The member *70c* includes a pair of movable contact springs *721a* and *722a*. Each of the springs *721a* and *722a* has one of its ends fixed to common terminals *711a* and *712a*, and the other of its ends opposing stationary contact terminals *73a* and *74b*, respectively. The common terminals *711a* and *712a* are connected together within the base member *7c* and protrude from the bottom thereof, as a signal terminal. It is possible to regulate a contact pressure preliminarily applied to the contact springs *721a* and *722a*, by twisting the respective common terminals *711a* and *712a* separately. In order to drive the contact members *70c* and *70d*, a pair of slits may be formed in the actuating part 64 (FIG. 3) of the movable block 6 to form a three-pronged fork.

A construction of the contact member of the base member *7c* shown in FIG. 11 will be described with reference to FIGS. 12A to 12C. In order to drive the contact member, the actuating part 64 comprises an outer stud 641, a center stud 642 and an inner stud 643, as mentioned with reference to FIG. 11. The stationary contact terminals *73a* and *74a* have stationary contacts 731 and 741, respectively. The movable contact springs *721a* and *722a* have movable contacts 7211 and 7221, respectively. The springs *721a* and *722a* have predetermined contact pressures such that they are in contact with the terminals *73a* and *74a*, respectively.

Figure 12A:
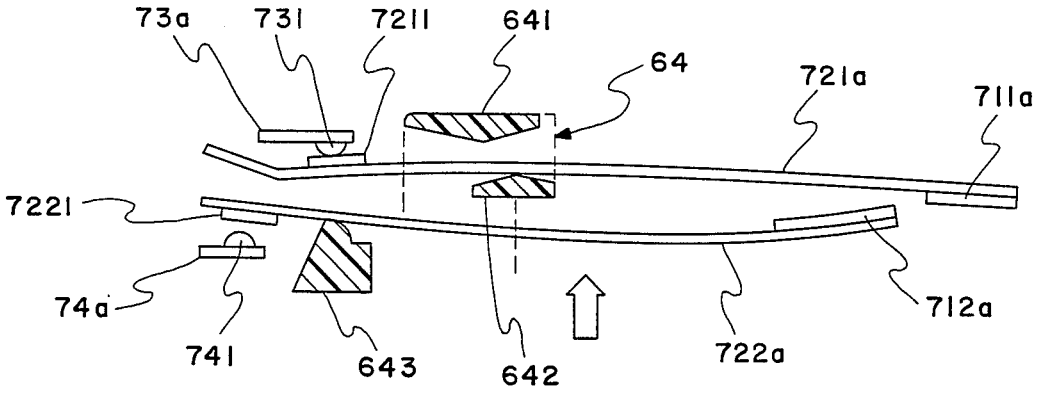
FIGS. 12A to 12C are views for illustrating an operation of a contact arrangement in the structure shown in FIG. 11.
Figure 12B:
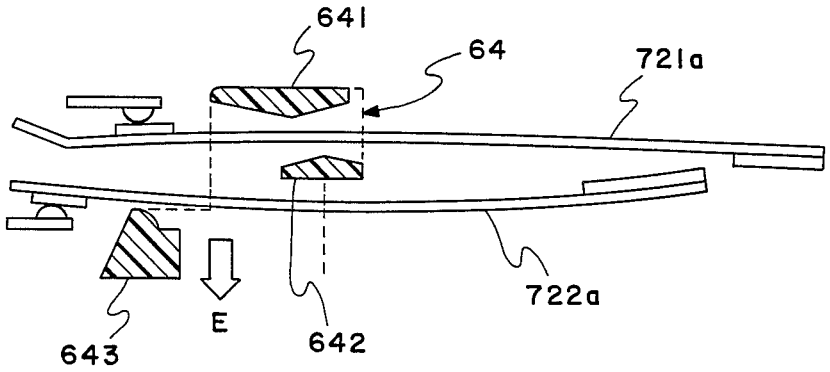

The stud 643 pushes the spring *722a* so that the contacts 7221 and 741 are broken and the stud 642 pushes the spring *721a* so that the contacts 7211 and 731 make (FIG. 12A).

The magnet unit (not shown) is moved slightly by magnetic force in a direction E, so that the pushing forces of the stud 642 and 643 acting on the springs *721a* and *722a* are released. Then, due to the predetermined contact pressures, the contacts 741 and 7221 make together and the contacts 731 and 7211 are kept in contact (FIG. 12B).

Figure 12C:
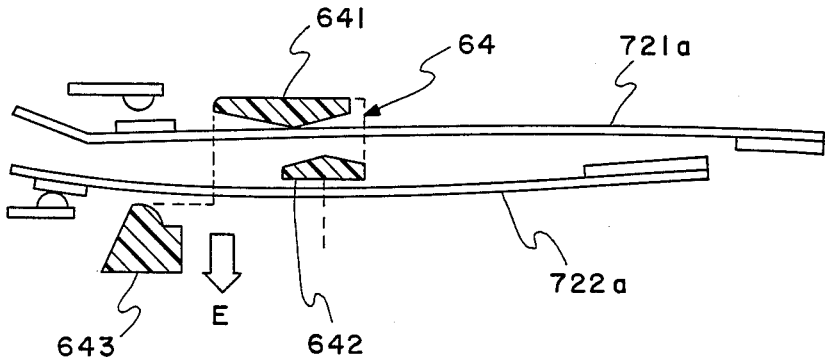

When the magnet unit (not shown) moves further, the stud 641 pushes the spring *721a* to break the contact between the contacts 731 and 7211 (FIG. 12C). Thus, there is an early-make-before-break contact in which the movable contact 7211 is opened after the movable contact 7221 is closed.

It is possible to assemble the base member *7b* having a contact member composed of a single movable contact spring and the base member *7c* having a contact member composed of a pair of movable contact springs to a single spool, so that a variety of contact constructions are realized in a single relay.

As described hereinbefore, according to the present invention, it is possible, in view of magnetic circuit construction, to obtain a stable closed magnetic circuit even if the assembling accuracy thereof is not satisfactory, and, in view of contact driving construction, to improve the assembling process as accurate as possible, therefore, a highly reliable relay is achieved.

What is claimed is:

1. A polarized electromagnetic relay comprising:

a movable block including a pair of permanent magnet units, each of said units being composed of a permanent magnet and a pair of generally U-shaped magnetic plates attached to opposite magnetic poles of said permanent magnet, respectively, each of said magnetic plates having a first end and a second end, said first end and said second end of each of said magnetic plates being opposed when attached to the poles of said permanent magnet, respectively, and a supporting member for supporting said permanent magnet units at its opposite ends, respectively, said supporting member actuating contact members responsive to movements of said permanent magnet units;

a core having opposite ends placed between the first ends of said magnetic plates, respectively;

a yoke having opposite ends, each of said opposite yoke ends being formed by a pair of opposing end pieces, the second ends of said magnetic plates being arranged in spaces, each of said spaces being defined by said opposing end pieces, respectively;

a spool including a longitudinal through-hole through which said core is inserted, flanges formed at opposite ends and a center portion of said spool, respectively, a plurality of protrusions protruding outwardly from both sides of each of said flanges, and a coil wound around said spool; and a pair of base members, each of said base members having groove and recesses for receiving the protrusions of said flanges of said spool, protrusions formed on side surfaces of inner walls of said base member for engaging the protrusions of said spool at the end of a longitudinal movement of the base member and contact members responsive to said movable block, said base members being assembled onto said spool from both ends thereof.

2. The polarized electromagnetic relay as claimed in claim 1 further comprising:

residual plates of non-magnetic material within gaps defined by said opposite ends of said core and said opposing first ends of said magnetic plates of said permanent masgnet units, respectively .

3. The polarized electromagnetic relay as claimed in claim 2 wherein said residual plates have different thicknesses to make an unbalanced magnetic resistance in a magnetic circuit.

4. The polarized electromagnetic relay as claimed in claim 3 further comprising:

residual plates having different thicknesses within gaps defind by said end pieces of said yoke and said second ends of said magnetic plates of said permanent magnet units, respectively

5. The polarized electromagnetic relay as claimed in claim 1 wherein the opposed areas of said end pieces of said yoke which are disposed along a first diagonal and said second ends of said magnetic plates which are disposed along said first diagonal are different from the opposed areas of the remaining end pieces of said yoke which are disposed along a second diagonal and the remaining ends of said magnetic plates which are disposed along said second diagonal.

6. The polarized electromagnetic relay as claimed in claim 1 wherein said contact member of at least one of said base members has two movable contact springs fixed to a common terminal on one end thereof, said movable contacts having individually associated opposed stationary contact terminals on the other end of said base members.

7. The polarized electromagnetic relay as claimed in claim 1 wherein said supporting member has magnet unit supporting portions of insulating resin formed at opposite ends thereof, a connecting portion of insulating resin for connecting said magnet unit supporting portions and a non-magnetic reinforcing frame, said magnet unit supporting portions and said connecting portion being formed on said reinforcing frame by insert-molding.

8. The polarized electromagnetic relay as claimed in claim 7 wherein said reinforcing frame is partially exposed in said connecting portion.

9. The polarized electromagnetic relay as claimed in claim 7 wherein said connecting portion has first and second bearing protrusions protruding horizontally and third and fourth bearing protrusions protruding horizontally and in opposite directions relative to said first and second protrusions and wherein said flanges of said spool formed at said center thereof include first and second pins protruding upwardly, said first and second pins being disposed between said first and second bearing protrusions and between said third and fuorth bearing protrusions, respectively, to form a rotary drive shaft of said movable block.

10. A polarized electromagnetic relay comprising:

a movable block including a pair of permanent magnet units, each of said units being composed of a permanent magnet and a pair of gnerally U-shaped magnetic plates attached to opposite magnetic poles of said permanent magnet, respectively, each of said magnetic plates having a first end and a second, said first end and said second ends of each of said magnetic plates being opossed when attached to the poles of said permanent magnet, respectively, and a supporting member for supporting said permanent magnet units at its opposite ends, respectively, said supporting member for actuating contact members responsive to movements of said permanent magnet units;

a core having opposite ends placed between the first ends of said magnetic plates, respectively;

a yoke having opposite ends, each of said opposite yoke ends being formed by an end piece, said end pieces being arranged diagonal to each other, diagonally positioned ones of the second ends of said magnetic plates being arranged inside said diagonal end pieces, respectively;

a spool including a longitudinal through-hole through which said core is inserted, flanges formed at opposite ends and a center portion of said spool, respectively, a plurality of protrusions protruding outwardly on both sides of each of said flanges, and a coil wound around said spool; and a pair of base members, each of said base members having grooves and recesses for receiving the protrusions of said flanges of said spools, protrusions formed on said surfaces of inner walls of said base member for engaging the protrusions of said spool by a longitudinal movement of the base member and contact members responsive to said movable block, said base members being assembled at said spool from both ends thereof.

11. The polarized electromagnetic relay as claimed in claim 10 further comprising:

residual plates of non-magnetic material within gaps defined by said opposite ends of said core and said opposing first ends of said magnetic plates of said permanent magnet units on the side of said pieces of said yoke, respectively.

12. The polarized electromagnetic relay as claimed in claim 1 further comprising:

residual plates having different thicknesses within gaps defined by said end pieces of said yoke and said second ends of said magnetic plates of said permanent magnet units, respectively.

13. The polarized electromagnetic relay as claimed in claim 10 wherein said contact member of at least one of said base members has two movable contact springs fixed to a common terminal on one end thereof and opposed to different stationary contact terminals on the other end thereof.

14. The polarized electromagnetic relay as claimed in claim 10 wherein said supporting member has magnet unit supporting portions of insulating resin formed at opposite ends thereof, a connecting portion of insulating resin for connecting said magnet unit supporting portions and a non-magnetic reinforcing frame, said magnet unit supporting portions and said connecting portion being formed on said reinforcing frame by insert-molding.

15. The polarized electromagnetic relay as claimed in claim 14 wherein said reinforcing frame is partially exposed in said connecting portion.

16. The polarized electromagnetic relay as claimed in cliam 14 wherein said connecting portion has first and second bearing protruding horizontally and third and fourth bearing protrusions protruding horizontally and in opposite directions relative to said first and second protrusions, and wherein said flanges of said spool formed at said center thereof include first and second pins protruding upwardly, said first and second pins being disposed between said first and second bearing protrusions and between said third and fourth bearing protrusions, respectively, to form a rotary drive shaft of said movable block.

17. A polarized electromagnetic relay comprising a stationary portion and a rotary portion, a plurality of orthagonally related spaced parallel protrusions on said stationary and rotary portions, said protrusions nesting to provide support with freedom for rotary motion with possible tilt for enabling self-alignment of said rotary portion during said rotation thereof, at least some of said protrusions having a generally circular cross section in their areas of nesting contact in order to form a bearing surface during said rotation, magnetic pole pieces on said rotary portion for giving a polarized rotary response depending upon the direction of energizing current applied to said relay, and contacts operated in response to said rotation of said rotary portion.

18. The polarized electromagnetic relay of claim 17 and pole pieces on aid stationary portion positioned to cooperate with said magnetic pole pieces, said pole pieces being positioned to form four air gaps in a generally rectangular plan whereby there are two pairs of diagonally related air gaps, and means for shaping said air gaps in one diagonally related pair of gaps relative to the shape of said air gaps in the other diagonally related pair of gaps for providing unbalanced magnetic forces whereby said rotary portion prefers to be in one rotary position as compared to another rotary position.

19. The polarized electromagnetic relay of claim 18 wherein said shape of said air gap is provided by unbalanced areas of confronting pole pieces.

20. The polarized electromagnetic relay of claim 18 wherein said shape of said air gap is provided by unbalanced thicknesses of material associated with said pole pieces.

* * * * *